US009603491B2

(12) United States Patent
Royal

(10) Patent No.: US 9,603,491 B2
(45) Date of Patent: Mar. 28, 2017

(54) EXPANDING CURTAIN

(71) Applicant: Michael Royal, Dallas, TX (US)

(72) Inventor: Michael Royal, Dallas, TX (US)

( * ) Notice: Subject to any disclaimer, the term of this patent is extended or adjusted under 35 U.S.C. 154(b) by 0 days.

(21) Appl. No.: 14/829,364

(22) Filed: Aug. 18, 2015

(65) Prior Publication Data

US 2016/0045080 A1 Feb. 18, 2016

Related U.S. Application Data

(60) Provisional application No. 62/038,540, filed on Aug. 18, 2014.

(51) Int. Cl.
*A47K 3/00* (2006.01)
*A47K 3/38* (2006.01)

(52) U.S. Cl.
CPC . *A47K 3/38* (2013.01); *A47K 3/00* (2013.01)

(58) Field of Classification Search
CPC ..... A47K 3/38
USPC ..... 4/596–614
See application file for complete search history.

(56) References Cited

U.S. PATENT DOCUMENTS 2,812,023 A * 11/1957 Laity, Sr. ..... E04B 2/827 160/183
3,293,664 A * 12/1966 Coons ..... A47K 3/325 4/599
3,463,174 A * 8/1969 Heller ..... B60J 11/00 135/119
7,987,534 B2 * 8/2011 Lin ..... A47K 3/38 4/557
8,122,531 B2 * 2/2012 Li ..... A47K 3/38 160/349.1
9,027,177 B2 * 5/2015 Perez ..... A47K 3/30 4/557
2006/0000499 A1 * 1/2006 Livacich ..... E04H 15/001 135/90
2013/0031718 A1 * 2/2013 Kelly ..... A47K 3/38 4/609

* cited by examiner

*Primary Examiner* — Lori Baker
(74) *Attorney, Agent, or Firm* — Kirby B. Drake; Klemchuk LLP

(57) ABSTRACT

An expanding curtain does not require the addition or installation of a new curved rod and/or any external curtain supports, control devices, or adapters to expand the usable space in the enclosure area and/or prevent the inward intrusion of the curtain towards the user. Rather, the curtain itself may have the strength, rigidity and/or fortitude to form an outwardly extended shape (e.g., away from the enclosure area) that may hold it in place, thus, expanding the amount of space available for utilization by the user of the enclosure area. The curtain easily and rapidly mounts and thereafter may be easily slidable/manipulated between an open and closed position. The curtain may surround, divide and/or provide privacy to a specific area and/or confined space. The curtain may also maintain a mold, mildew and germ resistant facade, while remaining inexpensive to manufacture.

18 Claims, 10 Drawing Sheets

EXPANDING CURTAIN

CROSS REFERENCE TO RELATED APPLICATION

This application claims the benefit under 35 U.S.C. §119 (e) of U.S. Provisional Patent Application Ser. No. 62/038,540 filed on Aug. 18, 2014, entitled "Expanding Curtain," which is incorporated by reference in its entirety.

FIELD OF THE DISCLOSURE

The present disclosure generally relates to curtains and liners, and more particularly, shower and bathtub waterproof curtains and liners.

BACKGROUND

Shower curtains are often used in combination with a waterproof liner wherein the curtain is maintained outside of the shower or bathtub and the liner is disposed inside, i.e., to act as a barrier for shower water. In some instances, the curtain itself is waterproof and is used as a liner or, optionally, as a decorative curtain and liner in one.

A typical bathtub, which often doubles as a shower stall, is approximately twenty-seven (27) inches wide. As such, even under ideal conditions, there may not be enough space for a user to move about without touching the side solid wall and the shower curtain (such as in the bathtub/shower depicted in FIG. 5), especially if the user has a large frame or has a disability. Further, it is generally recognized that a shower curtain that forms a portion of a shower or bathtub enclosure tends to be drawn inwardly, i.e., into the shower space, during shower use; thereby, providing even less space for a user (such as in the bathtub/shower depicted in FIG. 6). Other problems with conventional shower curtains include the clinging of the curtain to the body of the user, which could be significant in certain circumstances, as shower curtains are typically susceptible to the germs, mold and mildew created in the damp shower environment (especially in motels, hotels, hospitals, etc.).

A number of external shower curtain supports, control devices and adapters have been devised which typically provide supporting frames or arms mounted to a shower rod to prevent a shower curtain's inward draw and/or increase the space that a user may have within a shower area. Some devices involve tying the shower curtain to an outside object, which can be a cumbersome process and/or inhibit the ability of the curtain to be freely opened and closed. Other devices may involve altering the construction of the shower curtain rod itself. However, it may be desirable to remove the expanding device when the shower is not in use, especially in small washrooms. Still other devices have been provided that may be removed when not in use, however, these devices are often bulky and may occupy a substantial amount of space in the washroom even when they are not being used. Curved shower rods have been used to obtain increased space in a shower enclosure. However, such curved rods can be time consuming and/or difficult to install. Curved rods also continue to protrude in to the adjoining washroom area, even when not in use, which can be a significant detriment in small washrooms.

SUMMARY

Embodiments of the present disclosure may provide an expanding curtain for use to provide privacy to an area, the expanding curtain comprising: at least one sheet of rigid and flexible material; and at least one horizontal hinge joint positioned on the at least one sheet of rigid and flexible material to divide the expanding curtain into more than one panel, wherein the expanding curtain is manually manipulated to expand the amount of usable space in the area. The at least one sheet of rigid and flexible material may be selected from the group comprising: polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof. The at least one horizontal hinge joint may be formed by application of pressure and heat along the at least one horizontal hinge joint. The expanding curtain may further comprise a plurality of holes in a top section of the expanding curtain, the plurality of holes used to mount the expanding curtain on a curtain rod. The expanding curtain may slide along the curtain rod and compress into an accordion-like shape to allow entry and exit from the area. The expanding curtain may further comprise at least one vertical hinge joint to compress the expanding curtain into an accordion-like shape to allow entry and exit from the area. The at least one sheet of rigid and flexible material may be waterproof. The at least one horizontal hinge joint may be integrally formed with the at least one sheet of rigid and flexible material. The area may be a bathtub, and the width of the expanding curtain may correspond to the length of the bathtub. The expanding curtain may further comprise a façade selected from the group comprising: a mold resistant façade, a mildew resistant façade, a germ resistant façade, and combinations of the same.

Other embodiments of the present disclosure may provide an expanding shower curtain comprising a plurality of panels, each of the plurality of panels formed of a flexible material, wherein the plurality of panels are joined together to form and hold the plurality of panels in a desired angled outward position relative to a user occupying a shower area where the expanding shower curtain is placed. The plurality of panels may be integrally formed. The flexible material may be selected from the group comprising: polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof. The expanding shower curtain may further comprise at least one horizontal hinge joint positioned relative to the plurality of panels to divide the expanding curtain into more than one panel, wherein the expanding shower curtain may be manually manipulated to expand the amount of usable space in the shower area. The at least one horizontal hinge joint may be integrally formed with the plurality of panels.

Further embodiments of the present disclosure may provide an expanding curtain for use to provide privacy to an area, the expanding curtain comprising: at least one sheet of semi-rigid material; and at least one horizontal hinge joint positioned on the at least one sheet of semi-rigid material to divide the expanding curtain into more than one panel, wherein the expanding curtain may be manually manipulated in an outward direction relative to the area to expand the amount of usable space in the area. The semi-rigid material may be selected from the group comprising: polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof. The at least one horizontal hinge joint may comprise three horizontal hinge joints. The at least one horizontal hinge joint may be integrally formed with the at least one sheet of semi-rigid material.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Various embodiments of the present disclosure are described more fully hereinafter with reference to the accompanying drawings, in which some, but not all embodiments of the present disclosure are shown in the figures. Indeed, what is described herein may be embodied in many different forms and should not be construed as limited to the embodiments set forth herein.

There exists a need for a curtain that may effectively reduce and/or eliminate the inward intrusion of a curtain, such as during shower use, as well as a curtain's attendant propensity to touch and/or cling to the user. There also exists a need to increase the usable space within an area, such as a shower. There further exists a need for a curtain to avoid taking up valuable space, such as in a washroom, when the curtain is not in use, while still remaining simple to open and close as well as relatively inexpensive to manufacture.

Embodiments of the present disclosure may provide a new and unique shower curtain that may provide a number of important advantages. The new and unique curtain described herein does not require the addition or installation of a new curved shower rod and/or any external shower curtain supports, control devices, adapters, etc. to achieve its primary aims (i.e., to expand the useable space in the shower enclosure area and/or prevent the inward intrusion of the shower curtain towards the user). Rather, the new and unique curtain according to embodiments of the present disclosure may be designed and manufactured with a material so that the curtain itself will have the strength, rigidity and/or fortitude to form an outwardly extended shape (e.g., away from the shower and/or bathtub area) that may hold it in place, thus, expanding the amount of space available for utilization by the user of the shower and/or bathtub. The new and unique curtain may be easily and rapidly mounted—e.g., on any standard, straight curtain rod—existing or new (in any manner utilized to mount a standard shower curtain) and thereafter be easily slidable/manipulated between an open and closed position. A curtain according to embodiments of the present disclosure may be utilized to surround, divide and/or provide privacy to a specific area and/or confined space, including but not limited to, showers, bathtubs, hospital beds, hospital examination rooms, changing rooms, etc. The new and unique curtain may also take advantage of technology, materials and design advantages in order to maintain a mold, mildew and germ resistant facade, while remaining inexpensive to manufacture.

Embodiments of the present disclosure may be applicable to curtains, liners and/or drapes, and it should be appreciated that the word "curtain," as used herein, may denote curtains, drapes and/or liners (separately, as well as jointly) without departing from the present disclosure.

Figure 1:
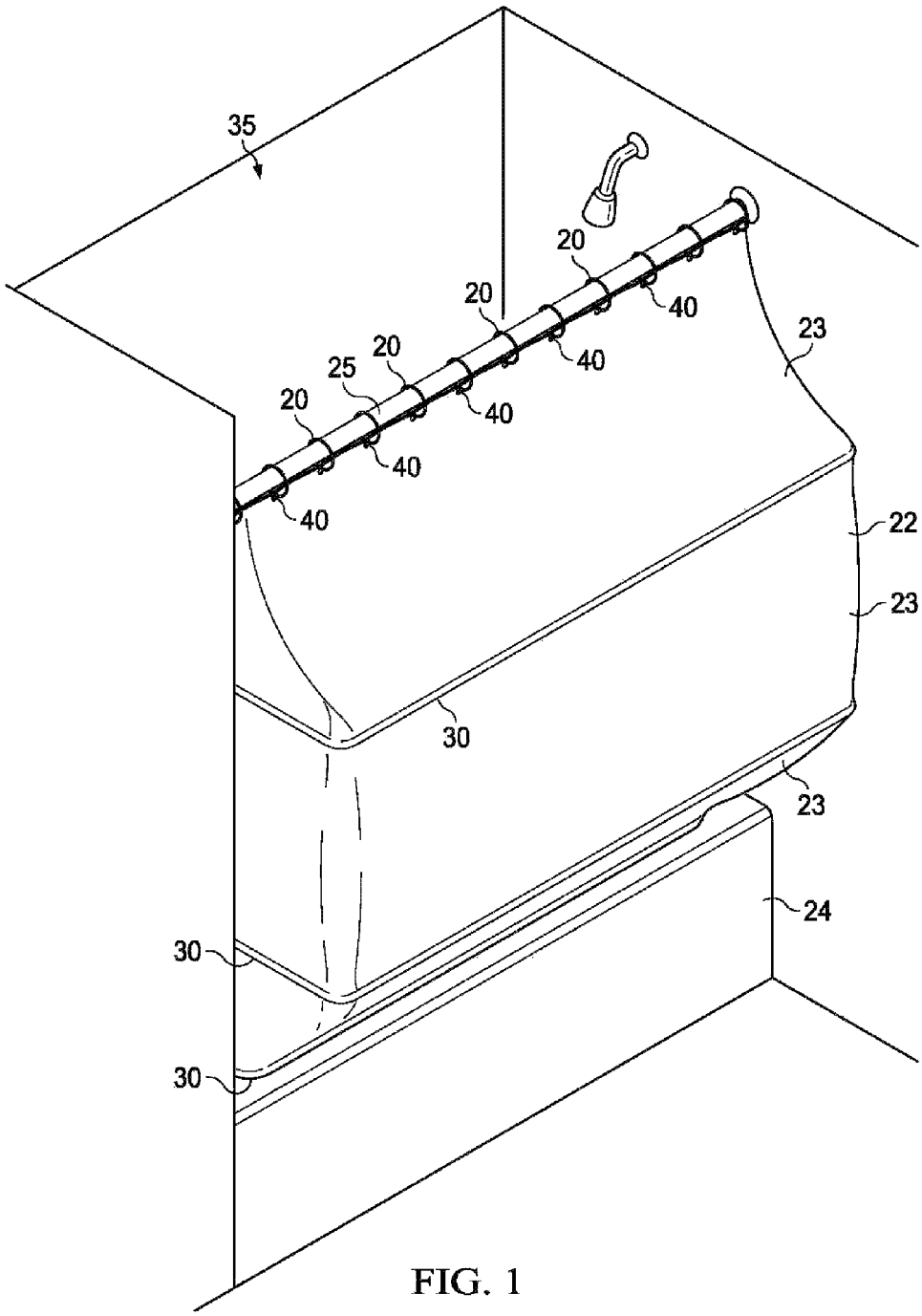
FIG. 1 depicts a perspective view of an expanding curtain according to an embodiment of the present disclosure.

FIG. 1 depicts a perspective view of an expanding curtain according to an embodiment of the present disclosure. As shown, FIG. 1 illustrates a perspective view of curtain 22. Curtain 22 is depicted in standard 3-wall bathtub 24/shower enclosure 35 exemplar; however, it should be appreciated that curtain 22 may be utilized in other situations without departing from the present disclosure. Curtain 22 is depicted as being mounted on straight shower rod 25 utilizing a plurality of standard shower curtain rings 20; however, other means for attaching curtain 22 to shower rod 25 may be employed without departing from the present disclosure.

Curtain 22 is shown in FIG. 1 with three (3) integrated, horizontal hinge/pivot joints 30. These integrated, horizontal hinge/pivot joints 30 may encourage curtain 22 to form and hold a similar desired shape/form each time curtain 22 is utilized. Stated alternatively, the type, thickness, and/or characteristics of the material of which curtain 22 is manufactured, combined with the design of curtain 22, shall provide sufficient strength, rigidity and/or fortitude to curtain 22 to allow it to be manually manipulated (i.e., by hand) in such a manner as to limit or prevent the intrusion of curtain 22 into a shower enclosure and significantly increase the amount of usable space within a shower enclosure. Moreover, curtain 22 may accomplish such results without the necessity of any external shower curtain supports, control devices, adapters, etc. or even a curved shower rod. While 3 integrated, horizontal hinge/pivot joints 30 are depicted in FIG. 1, it should be appreciated that there may be embodiments where more or fewer joints may be employed without departing from the present disclosure.

In this embodiment depicted in FIG. 1, curtain 22 may provide additional space to the user inside the shower (e.g., especially in the area that typically would correspond to a user's shoulders, torso and hips). Curtain 22 may be used, in part, to prevent water from splashing out the shower area during use of the shower. In such a manner, it is often desirable for curtain 22 to span substantially the entire length of the shower area. In the embodiment depicted in FIG. 1, curtain 22 width corresponds closely to the length of bathtub 24. However, in other embodiments of the present disclosure, the width of curtain 22 may be longer, shorter, or equal to the length of bathtub 24. Additionally or alternatively, curtain 22 may have a width that is sufficient to maintain a desired length of curtain 22 inside the lip of bathtub 24, i.e., for containing the water within bathtub 24. Curtain 22 also may be produced in sizes appropriate for use in a single, free standing shower stall.

Curtain 22 could also be used in a variety of embodiments involving non-shower applications, i.e., any area that requires a curtain and/or drape-type divider to surround, divide and/or provide privacy to a specific area and/or confined space, for example, around hospital beds, hospital examination rooms, changing rooms, etc. Curtain 22 also may be manufactured with a mold, mildew and/or germ resistant façade according to embodiments of the present disclosure.

The embodiment of curtain 22, as illustrated in FIG. 1, depicts curtain 22 as being made from one or more sheets of flexible, semi-rigid and/or rigid material. Curtain 22 may be generally rectangular in shape; however, curtain 22 may assume other shapes without departing from the present disclosure. Curtain 22 may be constructed from one or more materials including, but not limited to, polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof without departing from the present disclosure. It should be appreciated that the thickness of the material may differ depending on the material(s) used to form curtain 22 according to embodiments of the present disclosure. For example, if curtain 22 is formed from vinyl, the thickness may range from approximately 7 gauge to approximately 10 gauge.

Curtain 22 is depicted in FIG. 1 as having a series of holes 40 in the top section in order to provide for one manner of mounting curtain 22 (i.e., on a straight shower rod utilizing a plurality of standard shower curtain rings). In other embodiments of the present disclosure, curtain 22 could be altered to be capable of being mounted in a shower enclosure in any other manner in which curtains or liners are typically mounted in such circumstances.

Curtain 22 in FIG. 1 is shown with three (3) integrated, horizontal hinge/pivot joints 30, which divide curtain 22 into multiple panels 23. Hinge/pivot joints 30 could be formed through various methods including, but not limited to, the application of pressure and/or heat along horizontal hinge/pivot joint 30 (i.e., to form a "creased" effect), increasing the thickness of the material in such area, and/or any other method by which the desired result is obtained. It should be appreciated that more or fewer hinge/pivot joints 30 may be utilized without departing from the present disclosure.

Alternatively, multiple panels 23 that comprise curtain 22 could be manufactured separately of one or more types of flexible and/or semi-rigid material (including, but not limited to, polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof) and joined together by welding, adhesive, stitching, or similar connection method (thereby forming horizontal hinge/pivot joint 30). To the extent included, flexible, horizontal hinge/pivot joints 30 may allow the integrated (or discrete) multiple panels 23 of curtain 22 to generally form and hold various shapes, sizes and/or dimensions, by each maintaining multiple panels 23 in a desired angled outward position when the shower area is in use/occupied by a user. In other embodiments, curtain 22 could be comprised of one or more panels that are opaque or translucent, and/or potentially combined with one or more panels that are solid, colored, patterned, of a different texture, etc.

Figure 2:
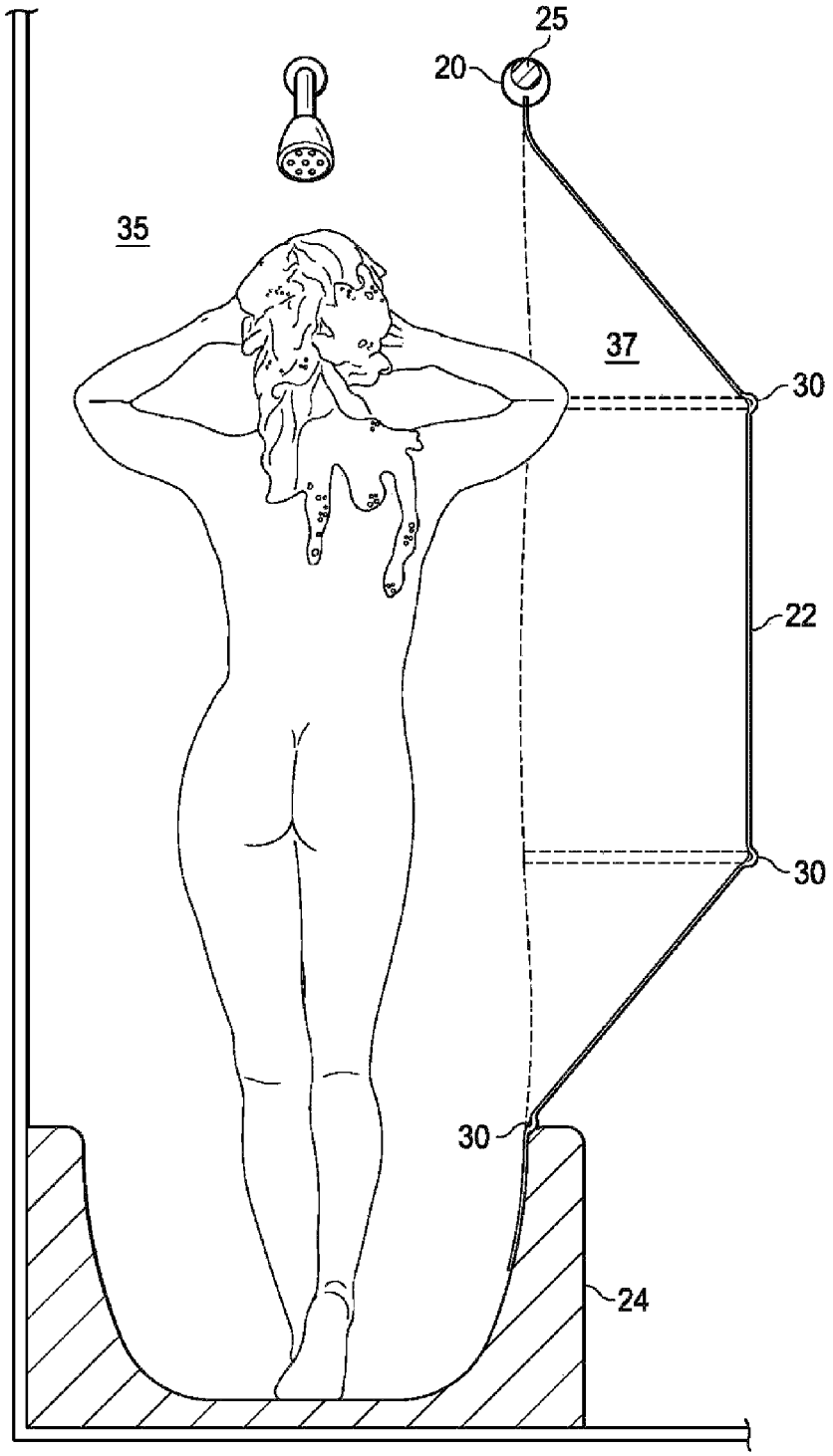
FIG. 2 depicts a side view of an expanding curtain according to an embodiment of the present disclosure.

FIG. 2 depicts a side view of the expanding curtain according to an embodiment of the present disclosure. Curtain 22 is shown in standard bathtub 24/shower enclosure 35 exemplar; although, it should be appreciated that curtain 22 may be utilized in other situations without departing from the present disclosure. Curtain 22 is depicted as being mounted on a straight shower rod 25 utilizing a plurality of standard shower curtain rings 20. Curtain 22 is shown in FIG. 2 with three (3) integrated, horizontal hinge/pivot joints 30. However, another embodiment of curtain 22 might have more or fewer horizontal hinge/pivot joints 30 or it might not have any defined, integrated, horizontal hinge/pivot joints 30 at all depending on space requirements and configuration, for example.

When a person desires to use the shower, he or she would manually manipulate curtain 22 into its desired outward shape (i.e., by using his or her hands), thereby, forming a shape that limits or prevents the intrusion of curtain 22 into the shower enclosure and significantly increasing the amount of usable space within a shower enclosure. It should be appreciated that in this embodiment of the present disclosure, curtain 22 provides additional space 37 to the user inside shower area 35 (e.g., especially in the area that typically would correspond to a user's shoulders, torso and hips).

Figure 3:
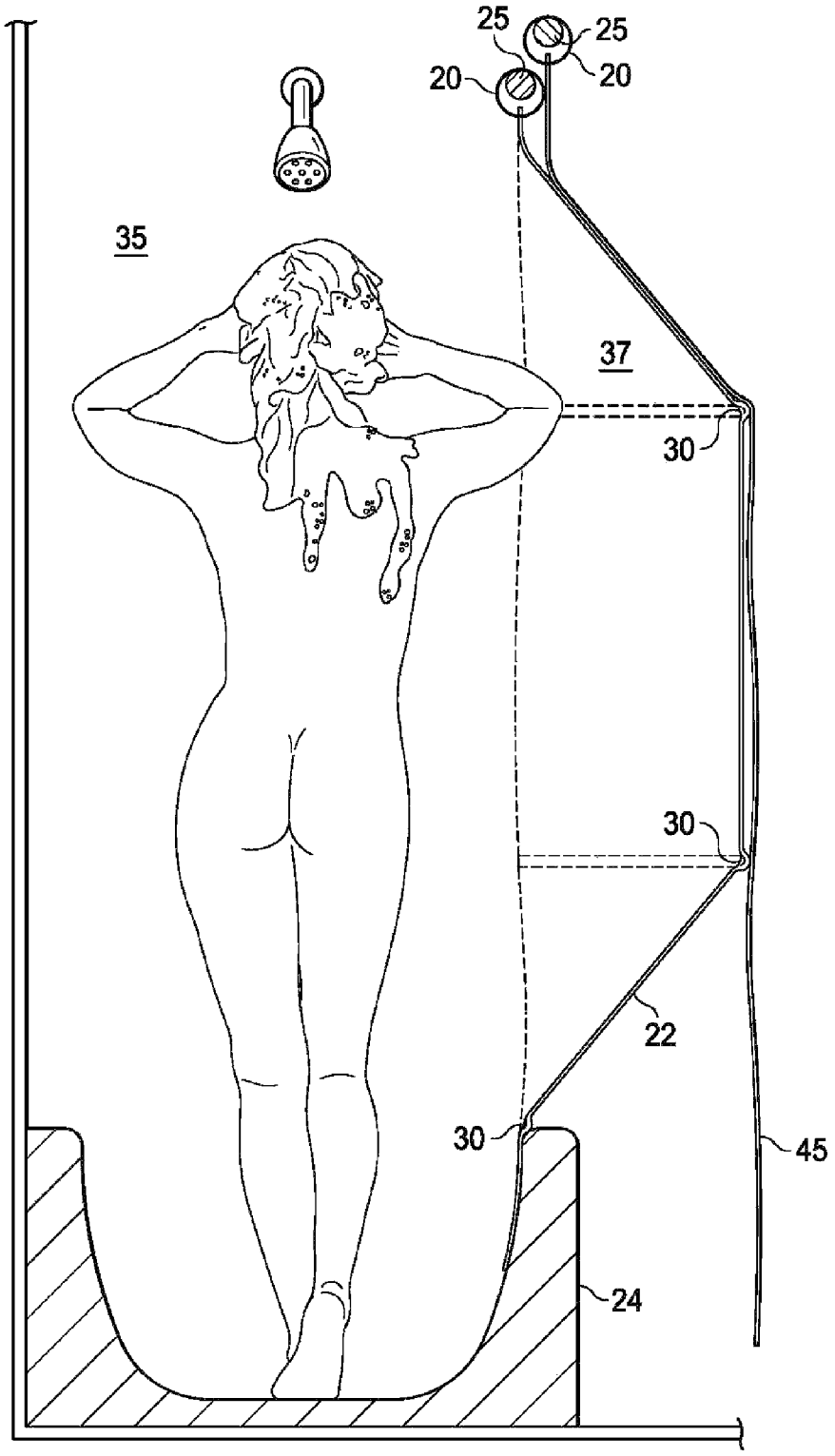
FIG. 3 depicts a side view of an expanding curtain according to an embodiment of the present disclosure.

FIG. 3 depicts a side view of the expanding curtain according to an embodiment of the present disclosure. Curtain 22 is shown in standard bathtub 24/shower enclosure 35 exemplar. Curtain 22 is depicted as being mounted on straight shower rod 25 utilizing a plurality of standard shower curtain rings 20. Curtain 22 is shown in FIG. 3 with three (3) integrated, horizontal hinge/pivot joints 30. In this embodiment of the present disclosure, curtain 22 provides additional space 37 to the user inside shower area 35 (e.g., especially in the area that typically would correspond to a user's shoulders, torso and hips). Also, curtain 22 in FIG. 3 is illustrated as being used as a waterproof shower liner, with an additional, separate exterior (non-curtain) drape/curtain 45 attached to the same (or a second) rod 25 (i.e., for decorative, etc. purposes).

Figure 4:
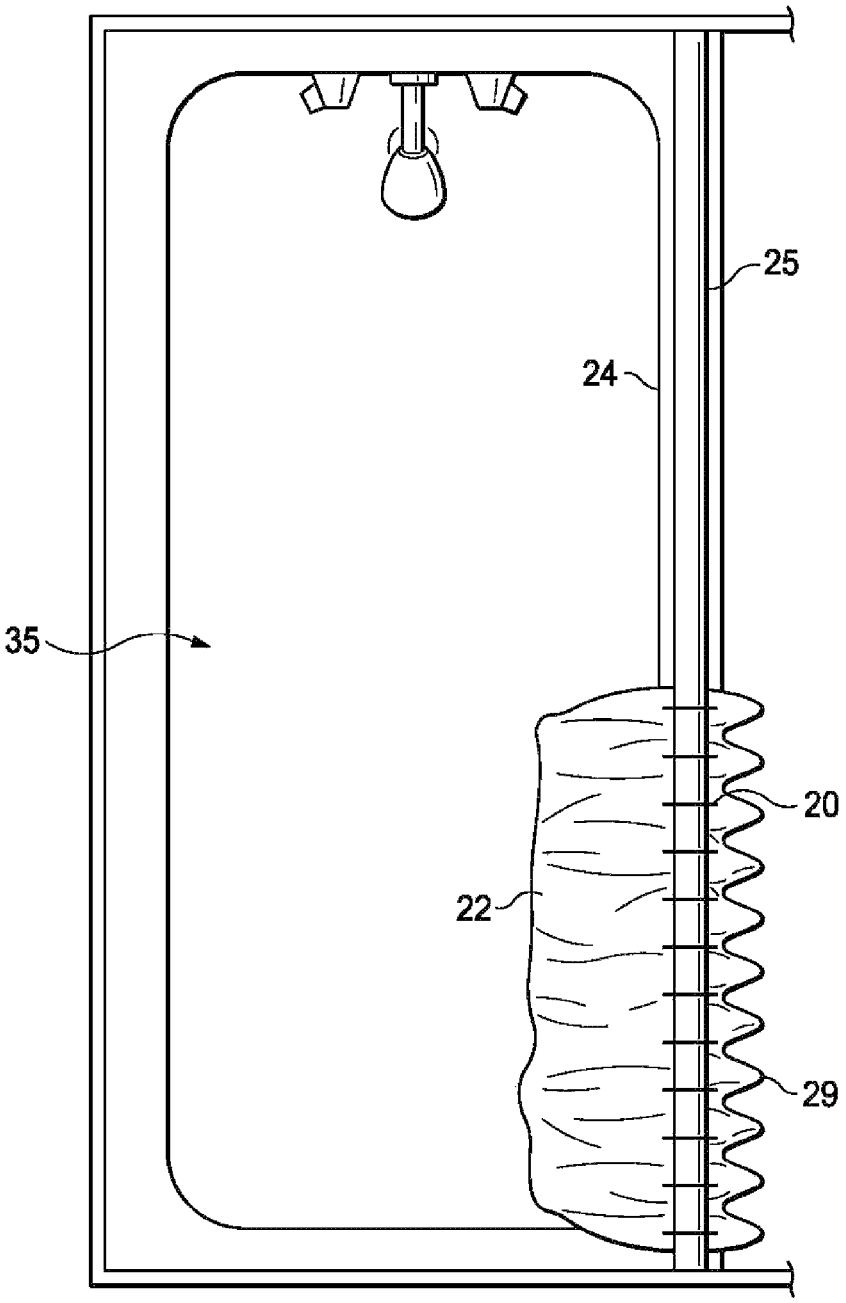
FIG. 4 depicts a top view of an expanding curtain according to an embodiment of the present disclosure.
Figure 5:
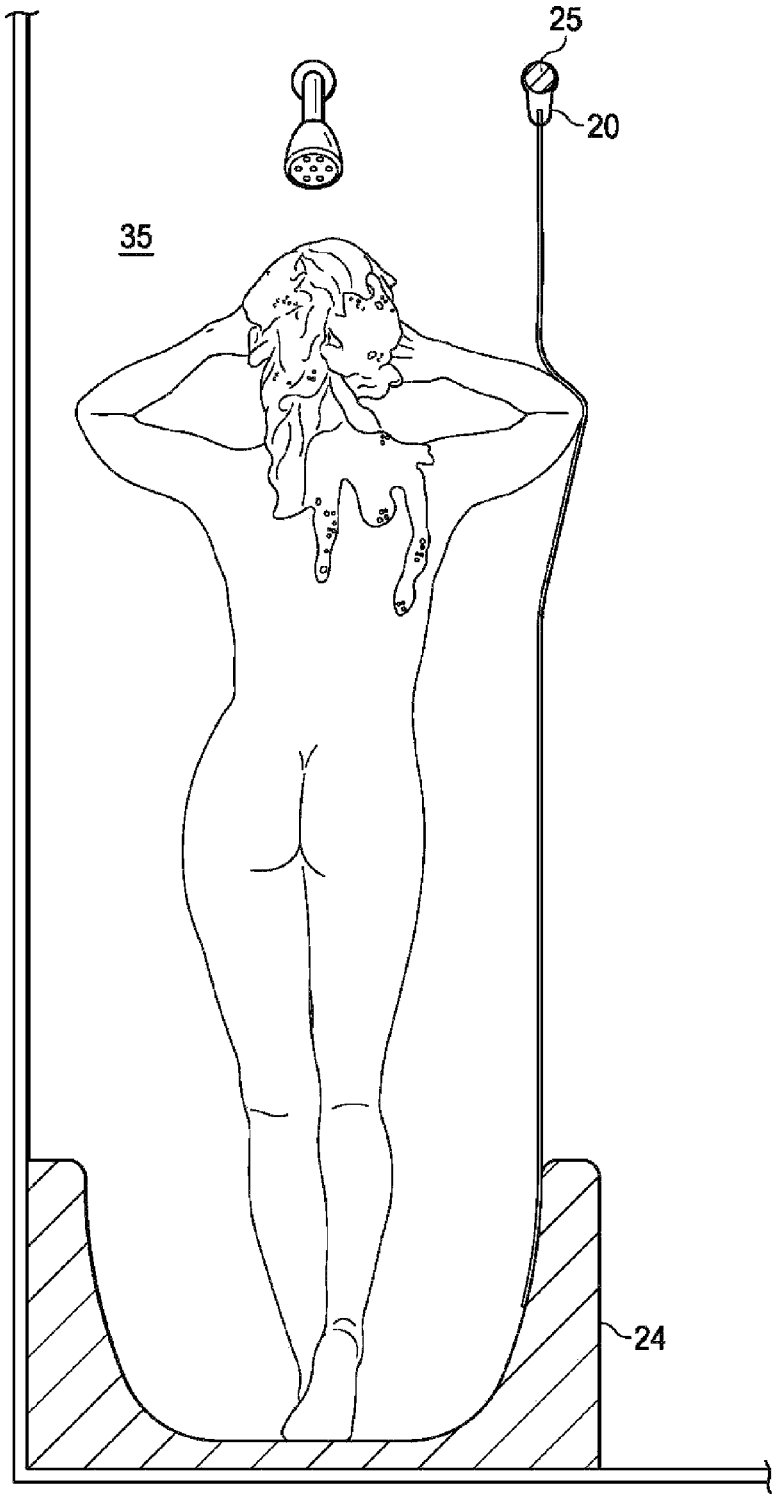
FIG. 5 (PRIOR ART)
FIG. 5 depicts a side view of a standard shower curtain.
Figure 6:
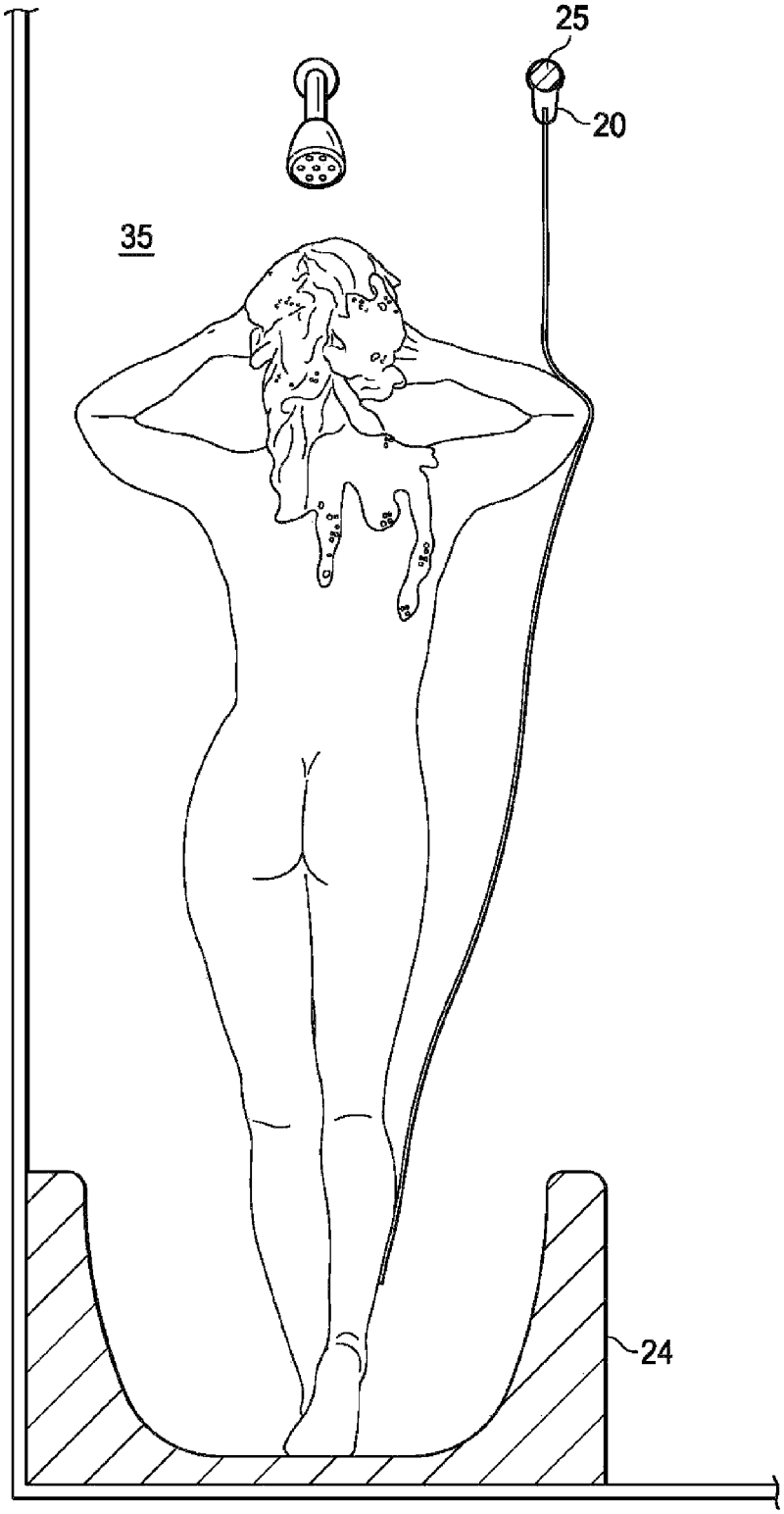
FIG. 6 (PRIOR ART)
FIG. 6 depicts a side view of a standard shower curtain.

FIG. 4 depicts a top view of the expanding curtain according to an embodiment of the present disclosure. In this embodiment of the present disclosure, curtain 22 has been manipulated in to a position whereby the entirety of curtain 22 has been pushed back in to the shower/bathtub area 35 (i.e., the position that curtain 22 might take when shower area 35 is not being used), in accordance with the user's preferences. In this position, curtain 22 takes up minimal, if any, space in the washroom outside of the shower area itself. Moreover, curtain 22 is depicted as having been manually manipulated/slid along rod 25 to the side of shower enclosure 35, so that curtain 22 is compressed together in an "accordion-like" shape 29. This feature allows for easy entrance and exit from shower area 35. Another alternative for opening (and the maintenance of curtain 22 in an open position) would be to open and hold curtain 22 in place in a "Roman-shade" fashion. In other embodiments of the present disclosure, curtain 22 could have one or more integrated, vertical hinge/pivot joints (similar to the integrated, horizontal hinge/pivot joints described above), i.e., in order to encourage the curtain to assume an "accordion-like" shape when opened by the user.

Figure 7:
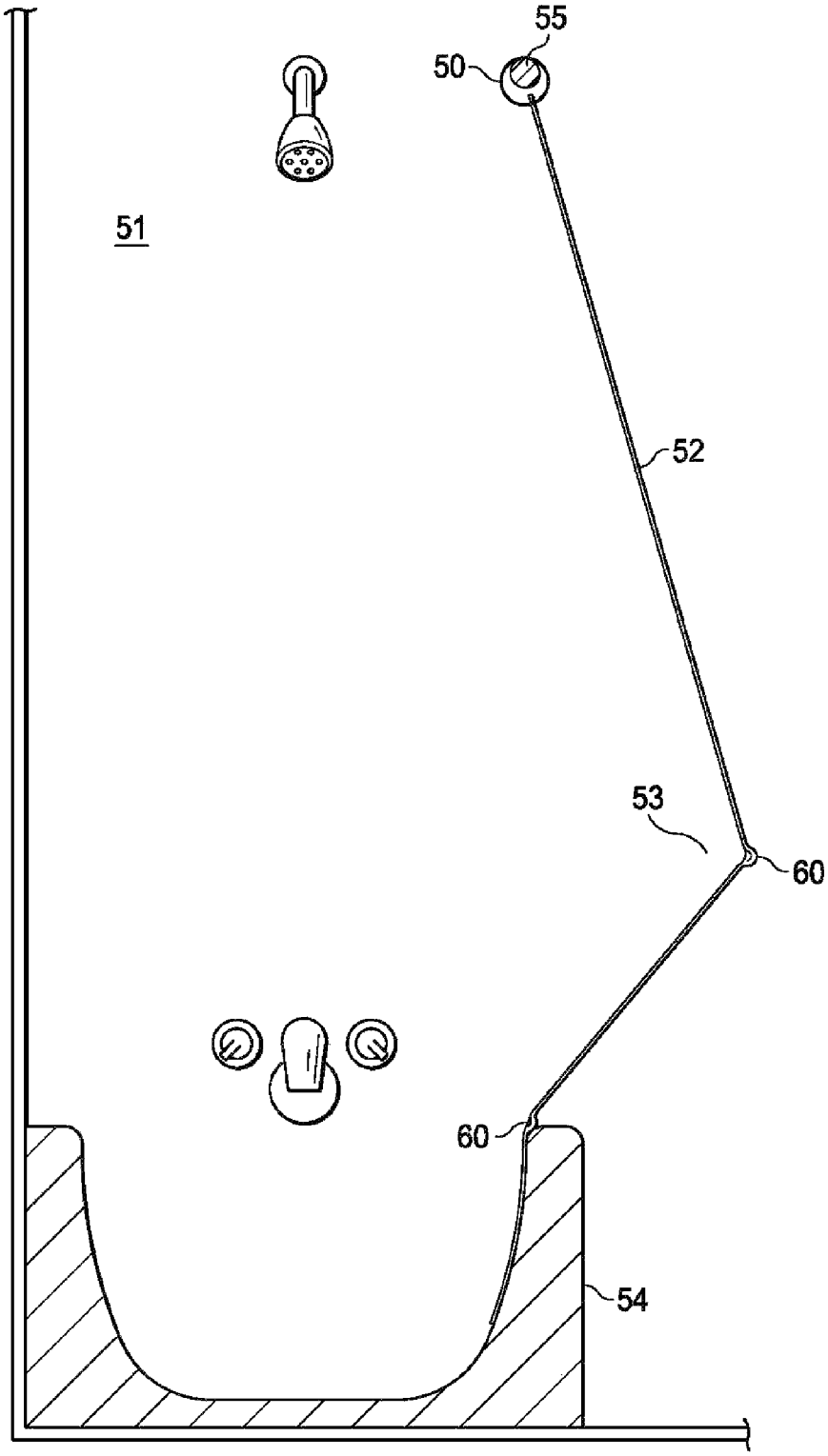
FIG. 7 depicts a side view of an expanding curtain according to another embodiment of the present disclosure.

FIG. 7 depicts a side view of the expanding curtain according to another embodiment of the present disclosure. Curtain 52 is shown in a standard bathtub 54/shower enclosure 51 exemplar although it may be utilized in other situations without departing from the present disclosure. Curtain 52 is depicted as being mounted on straight shower rod 55 utilizing a plurality of standard shower curtain rings 50. Curtain 52 is shown in FIG. 7 with two (2) integrated, horizontal hinge/pivot joints 60. However, an alternative embodiment of curtain 52 might have more or fewer horizontal hinge/pivot joints 60 or it might not have any defined, integrated, horizontal hinge/pivot joints 60 at all depending on the requirements of a specific application. When a person desires to use shower area 51, he or she would manually manipulate curtain 52 into its desired shape (i.e., by using his or her hands), thereby forming a shape that limits or prevents the intrusion of curtain 52 into the shower enclosure 51 and significantly increases the amount of usable space 53 within shower enclosure 51.

Figure 8:
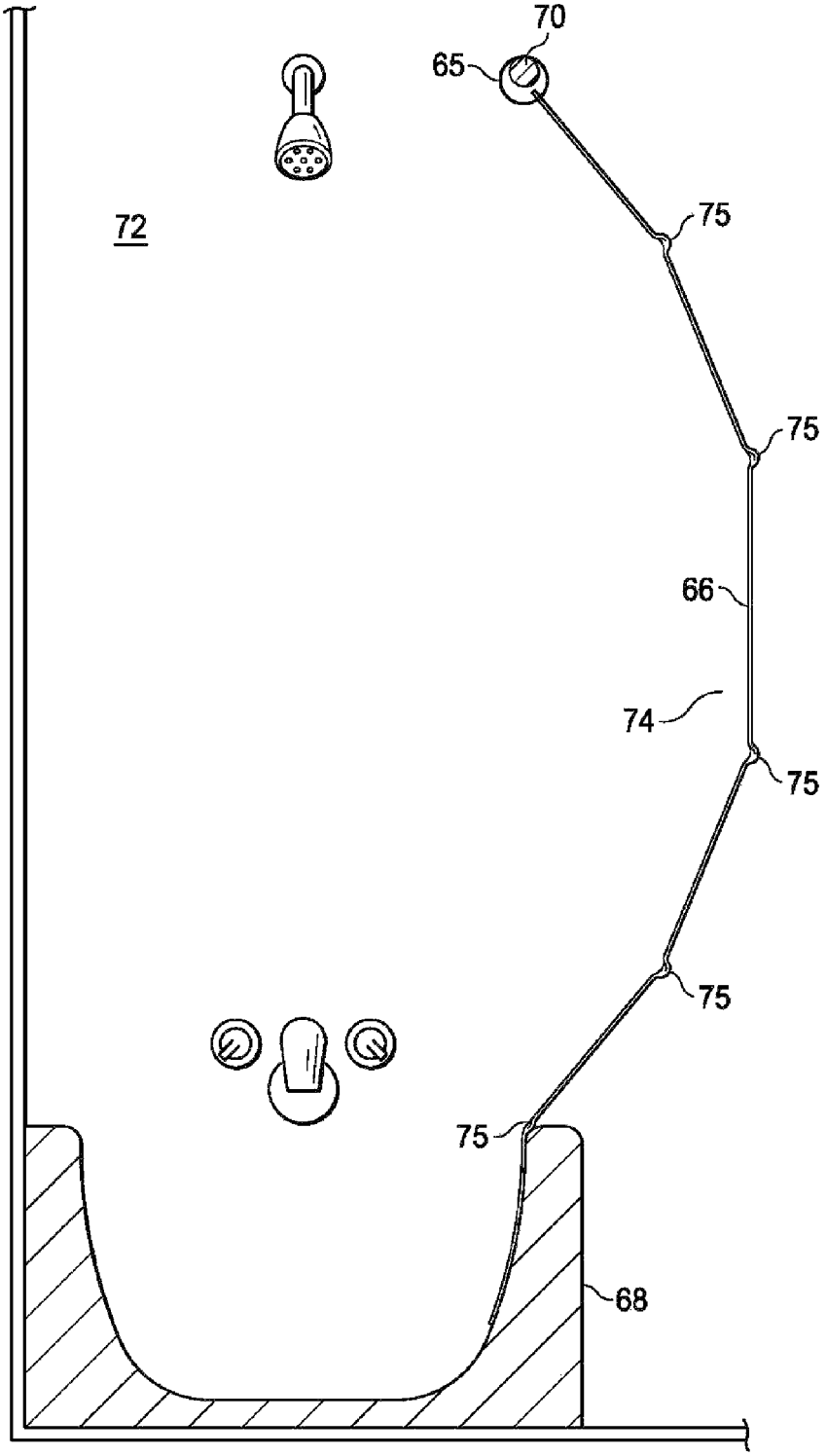
FIG. 8 depicts a side view of an expanding curtain according to another embodiment of the present disclosure.

FIG. 8 depicts a side view of the expanding curtain according to another embodiment of the present disclosure. Curtain 66 is shown in a standard bathtub 68/shower enclosure 72 exemplar although it may be utilized in other situations according to embodiments of the present disclosure. Curtain 66 is depicted as being mounted on straight shower rod 70 utilizing a plurality of standard shower curtain rings 65. Curtain 66 is shown in FIG. 8 with five (5) integrated, horizontal hinge/pivot joints 75. However, an alternative embodiment of curtain 66 might have more or fewer horizontal hinge/pivot joints 75 or it might not have any defined, integrated, horizontal hinge/pivot joints 75 at all depending on the requirements of a specific application. When a person desires to use shower area 72, he or she would manually manipulate curtain 66 into its desired shape (i.e., by using his or her hands), thereby, forming a shape that limits or prevents the intrusion of curtain 66 into shower enclosure 72 and significantly increases the amount of usable space 74 within shower enclosure 72.

Figure 9:
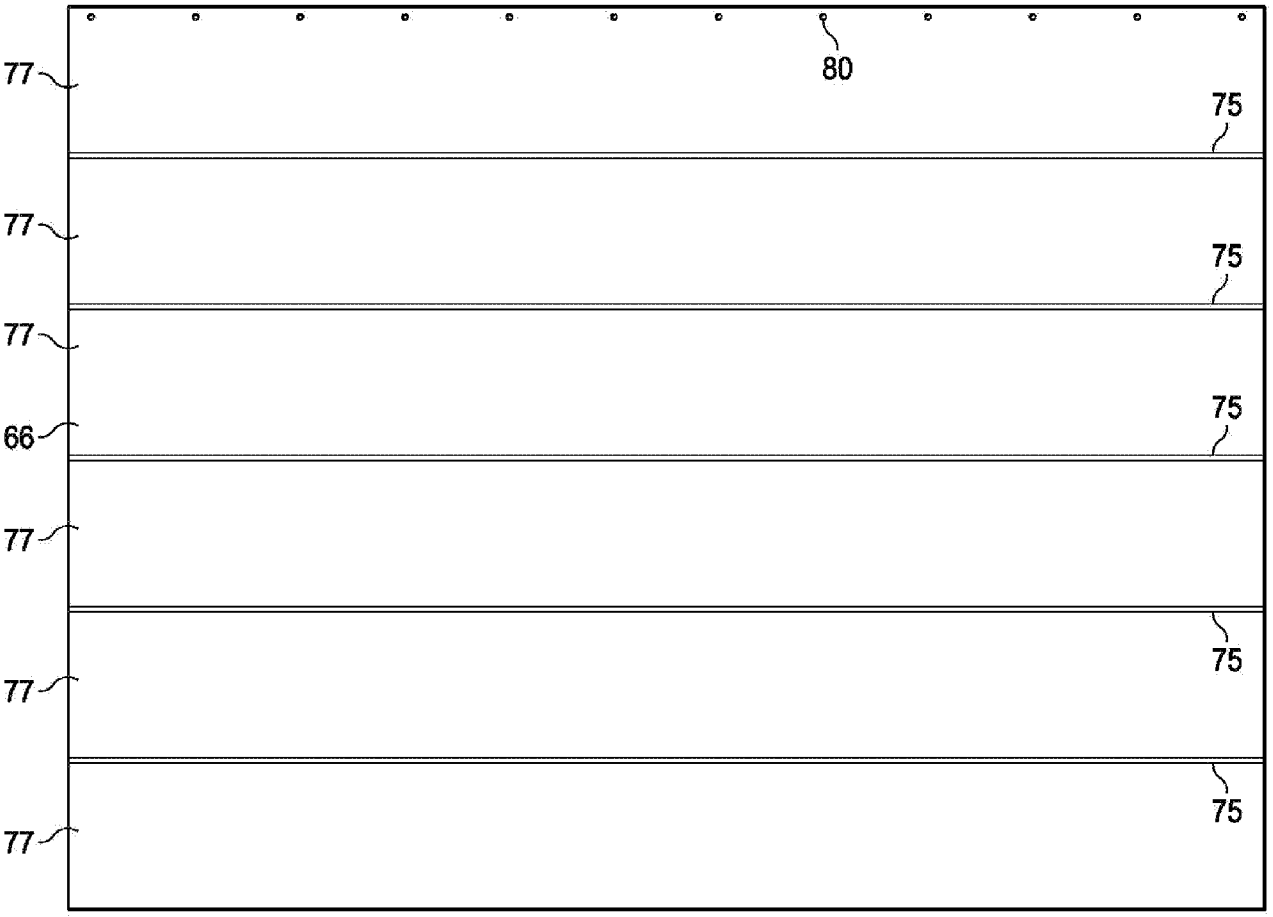
FIG. 9 depicts a front view of an expanding curtain according to another embodiment of the present disclosure.

FIG. 9 depicts a front view of the expanding curtain according to another embodiment of the present disclosure. The alternative embodiment of curtain 66, as illustrated in FIG. 9 (which is a different view of the alternative embodiment illustrated in FIG. 8), evidences curtain 66 as being made from one or more sheets of flexible material. Curtain 66 is generally rectangular in shape; however, it may assume other shapes without departing from the present disclosure. Curtain 66 could be constructed of one or more materials including, but not limited to, polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof.

Curtain 66 is depicted in FIG. 9 as having a series of holes 80 in the top section, in order to provide for one manner of mounting curtain 66 (i.e., on a straight shower rod utilizing a plurality of standard shower curtain rings). In other embodiments of the present disclosure, curtain 66 could be altered to be capable of being mounted in a shower enclosure in any other manner in which curtains or liners are typically mounted in such circumstances.

Curtain 66 in FIG. 9 is shown with five (5) integrated, horizontal hinge/pivot joints 75, which divide curtain 66 into multiple panels 77. Hinge/pivot joints 75 could be formed by one or more methods including, but not limited to, the application of pressure and/or heat all along horizontal hinge/pivot joints 75 (i.e., to form a "creased" effect), increasing the thickness of the material in such area, and/or any other method by which the desired result is obtained. Alternatively, multiple panels 77 that comprise curtain 66 could be manufactured separately of one or more types of flexible and/or semi-rigid material (e.g., polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof) and joined together by welding, adhesive, stitching, or similar connection method (thereby forming the desired horizontal hinge/pivot joint).

Flexible, horizontal hinge/pivot joints 75 allow integrated (or discrete) panels 77 of curtain 66 to form and hold various shapes, sizes and/or dimensions, by each maintaining curtain panels 77 in a desired angled outward position when the shower area is in use/occupied by a user. However, in another embodiment of the present disclosure, curtain 66 might have more or fewer horizontal hinge/pivot joints 75 or it might not have any defined, integrated, horizontal hinge/pivot joints 75 at all depending on the requirements of a specific application.

Figure 10:
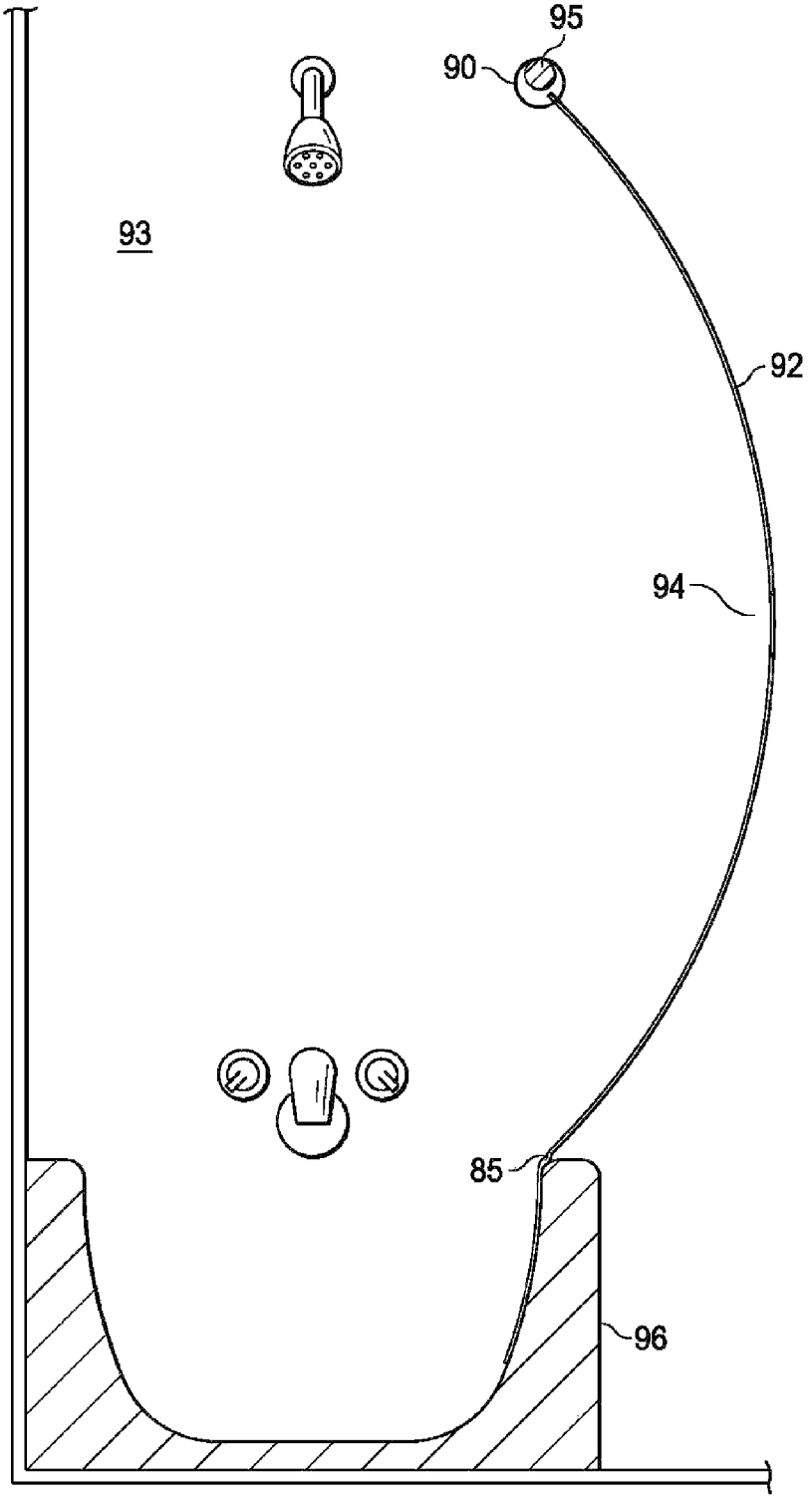
FIG. 10 depicts a side view of an expanding curtain according to another embodiment of the present disclosure.

FIG. 10 depicts a side view of the expanding curtain according to another embodiment of the present disclosure. Curtain 92 is shown in standard bathtub 96/shower enclosure 93 exemplar. Curtain 92 is depicted as being mounted on straight shower rod 95 utilizing a plurality of standard shower curtain rings 90. Curtain 92 is shown in FIG. 10 with one (1) integrated, horizontal hinge/pivot joint 85. However, in other embodiments of the present disclosure, curtain 92 might have more or fewer horizontal hinge/pivot joints 85 or it might not have any defined, integrated, horizontal hinge/pivot joints 85 at all depending on the requirements of a specific application. When a person desires to use shower area 93, he or she would manually manipulate curtain 92 in to its desired shape (i.e., by using his or her hands), thereby forming a shape that limits or prevents the intrusion of curtain 92 into the shower enclosure and significantly increase the amount of usable space 94 within a shower enclosure 93.

In summary, a new and unique curtain is presented that effectively reduces and/or eliminates the inward intrusion of a shower curtain during shower use (and its attendant propensity to touch and/or cling to the user), significantly increasing the usable space within a shower area, and the curtain does not take up valuable space in the washroom when not in use but remains simple to open and close, as well as inexpensive to manufacture.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An expanding curtain for use to provide privacy to an area, the expanding curtain comprising:

at least one sheet of rigid and flexible material; and at least one horizontal hinge joint integrally formed in the at least one sheet of rigid and flexible material to divide the expanding curtain into more than one panel, wherein the expanding curtain is manually manipulated to expand the amount of usable space in the area without the use of a mechanical device external to the expanding curtain.

2. The expanding curtain of claim 1, wherein the at least one sheet of rigid and flexible material is selected from the group comprising:

polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof.

3. The expanding curtain of claim 1, wherein the at least one horizontal hinge joint is formed by application of pressure and heat along the at least one horizontal hinge joint.

4. The expanding curtain of claim 1 further comprising:

a plurality of holes in a top section of the expanding curtain, the plurality of holes used to mount the expanding curtain on a curtain rod.

5. The expanding curtain of claim 4 wherein the expanding curtain slides along the curtain rod and compresses into an accordion-like shape to allow entry and exit from the area.

6. The expanding curtain of claim 1 further comprising:

at least one vertical hinge joint to compress the expanding curtain into an accordion-like shape to allow entry and exit from the area.

7. The expanding curtain of claim 1 wherein the at least one sheet of rigid and flexible material is waterproof.

8. The expanding curtain of claim 1 wherein the at least one horizontal hinge joint is integrally formed with the at least one sheet of rigid and flexible material.

9. The expanding curtain of claim 1 wherein the area is a bathtub.

10. The expanding curtain of claim 9 wherein the width of the expanding curtain corresponds to the length of the bathtub.

11. The expanding curtain of claim 1 further comprising a façade selected from the group comprising:

a mold resistant façade, a mildew resistant façade, a germ resistant façade, and combinations of the same.

12. An expanding shower curtain comprising:

a plurality of panels, each of the plurality of panels formed of a flexible material, wherein the plurality of panels are joined together to form and hold the plurality of panels in a desired angled outward position relative to a user occupying a shower area where the expanding shower curtain is placed, without the use of a mechanical device external to the expanding curtain.

13. The expanding shower curtain of claim 12 wherein the plurality of panels are integrally formed.

14. The expanding shower curtain of claim 12 wherein the flexible material is selected from the group comprising:

polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof.

15. The expanding shower curtain of claim 12 further comprising:

at least one horizontal hinge joint integrally formed relative to the plurality of panels to divide the expanding curtain into more than one panel, wherein the expanding shower curtain is manually manipulated to expand the amount of usable space in the shower area.

16. An expanding curtain for use to provide privacy to an area, the expanding curtain comprising:

at least one sheet of semi-rigid material; and at least one horizontal hinge joint integrally formed in the at least one sheet of semi-rigid material to divide the expanding curtain into more than one panel, wherein the expanding curtain is manually manipulated in an outward direction relative to the area to expand the amount of usable space in the area.

17. The expanding curtain of claim 16 wherein the semi-rigid material is selected from the group comprising:

polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof.

18. The expanding curtain of claim 16 wherein the at least one horizontal hinge joint comprises three horizontal hinge joints.

* * * * *